US007886707B2

(12) United States Patent
Takemoto et al.

(10) Patent No.: US 7,886,707 B2
(45) Date of Patent: Feb. 15, 2011

(54) DECOMPRESSOR FOR INTERNAL COMBUSTION ENGINE

(75) Inventors: Kazuhisa Takemoto, Saitama (JP); Kazuhiro Shimazaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 451 days.

(21) Appl. No.: 12/119,219

(22) Filed: May 12, 2008

(65) Prior Publication Data

US 2008/0302321 A1 Dec. 11, 2008

(30) Foreign Application Priority Data

Jun. 8, 2007 (JP) ..... 2007-153197

(51) Int. Cl.
*F01L 13/00* (2006.01)

(52) U.S. Cl. ..... 123/182.1

(58) Field of Classification Search ..... 123/182.1
See application file for complete search history.

(56) References Cited

U.S. PATENT DOCUMENTS

| | | | | |
|---|---|---|---|---|
| 3,897,768 | A * | 8/1975 | Thiel | 123/182.1 |
| 6,269,786 | B1 * | 8/2001 | Snyder et al. | 123/182.1 |
| 6,899,073 | B2 * | 5/2005 | Tsutsumi et al. | 123/182.1 |
| 7,726,271 | B2 * | 6/2010 | Yamanishi et al. | 123/182.1 |
| 2004/0261744 | A1 * | 12/2004 | Tsutsumi et al. | 123/182.1 |
| 2008/0011257 | A1 * | 1/2008 | Iwama et al. | 123/182.1 |
| 2008/0035089 | A1 * | 2/2008 | Yamanishi et al. | 123/182.1 |

FOREIGN PATENT DOCUMENTS

| | | |
|---|---|---|
| EP | 1 460 240 A2 | 9/2004 |
| JP | 2006-144627 A | 6/2006 |

* cited by examiner

*Primary Examiner*—John T Kwon
*Assistant Examiner*—Arnold Castro
(74) *Attorney, Agent, or Firm*—Birch, Stewart, Kolasch & Birch, LLP

(57) ABSTRACT

A decompressor for an internal combustion engine that is capable of preventing the dropping-off of the decompression shaft during maintenance work includes a falling-off prevention pin inserted into a pin insertion hole having an opening to the outer circumferential surface of a camshaft and intersecting, at least partially, an insertion hole. A decompression shaft is inserted and fitted into the insertion hole. The falling-off prevention pin engages with the decompression shaft while the decompression shaft is allowed to rotate. The decompression shaft is prevented from moving in the axial direction of the decompression shaft. The opening of the pin insertion hole of the camshaft into which the falling-off prevention pin is inserted is blocked by a bearing. A swing portion includes a bearing-restriction portion formed so as to protrude towards the bearing. The bearing-restrict portion restricts the movement of the bearing in the axial direction of the camshaft.

20 Claims, 10 Drawing Sheets

DECOMPRESSOR FOR INTERNAL COMBUSTION ENGINE

CROSS-REFERENCE TO RELATED APPLICATIONS

The present application claims priority under 35 USC 119 to Japanese Patent Application No. 2007-153197 filed on Jun. 8, 2007 the entire contents of which are hereby incorporated by reference.

BACKGROUND OF THE INVENTION

1. Field of the Invention

The present invention relates to a decompressor that facilitates the starting of an internal combustion by opening an engine valve to release the pressure compressed by a piston at the start of the engine.

2. Description of Background Art

An example of known decompressors for an internal combustion engine includes a decompression shaft and a decompression pin (decompression plunger). See, for example, Japanese Patent Application Publication No. 2006-144627. The decompression shaft is inserted in an insertion hole of the camshaft in the axial direction. The decompression pin, on the other hand, is disposed in a pin hole (plunger hole) formed in the camshaft orthogonally to the axial direction. The decompression pin thus disposed is movable inside the pin hole. The decompression shaft and the decompression pin engage with each other. With a rotational movement of the decompression shaft, the decompression pin moves between the decompressing position, wherein the decompression pin opens the engine valve, and the decompression-cancelling position, wherein the decompression pin does not open the engine valve.

In the decompressor disclosed in Japanese Patent Application Publication No. 2006-144627, the decompression shaft is inserted in the insertion hole in the axial direction so as to be removable from the insertion hole. An eccentric protruding portion is formed in an end portion of the decompression shaft, from which end portion the decompression shaft is inserted into the insertion hole. The eccentric protruding portion engages with a recessed groove which is formed in the side surface of the decompression pin.

A centrifugal weight is provided at the other end of the decompression shaft. The swinging movement of the centrifugal weight makes the decompression shaft rotate. The whirling of the eccentric protruding portion, which moves along with the rotation of the decompression shaft, moves the decompression pin in the radial direction of the camshaft. The decompression pin thus moved appears above the cam face of the camshaft.

The position where the decompression pin sticks out of the cam face is the decompressing position to open the engine valve, while the position where the decompression pin submerges below the cam face is the decompression-cancelling position to keep the engine valve closed.

When the drive mechanism that drives the decompression shaft is removed from the camshaft during maintenance work on the internal combustion engine or the like, or in a similar case, the decompression shaft, which is designed to be removably inserted in the insertion hole, may possibly fall out of the camshaft. When the decompression shaft actually falls off, the eccentric protruding portion may possibly disengage from the recessed groove of the decompression pin. When this happens, the decompression pin may possibly fall off as well. As a consequence, the maintenance work is difficult.

SUMMARY AND OBJECTS OF THE INVENTION

The present invention was made in view of the above-described problems, and aims to provide a decompressor for an internal combustion engine that is capable of preventing, with a simple configuration, the falling-off of the decompression shaft during maintenance work.

For the purpose of solving the above-mentioned problems, according to an embodiment of the present invention a decompressor for an internal combustion engine is provided with the following features. The decompressor performs decompression and cancels the decompression by moving a decompression shaft relative to a camshaft to make an emerging-and-submerging decompression portion of the decompression shaft emerge above and submerge below a cam face of a valve-moving cam formed on the outer circumferential surface of the camshaft. The decompression shaft is supported so as to be rotatable freely, and the camshaft is supported by a bearing so as to be rotatable freely and for driving an engine valve by use of the valve-moving cam. In addition, the decompression shaft is inserted and fitted into an insertion hole so as to be rotatable relative to the camshaft, the insertion hole having an opening in a first end face of the camshaft and drilled in the axial direction of the camshaft at a position eccentric to the rotational axis of the camshaft. A swing portion is provided at a first end of the decompression shaft, and extends along the first end face of the camshaft in a radial direction of the decompression shaft. Furthermore, by engaging a falling-off prevention pin with the decompression shaft while allowing the decompression shaft to rotate, the decompression shaft is prevented from moving in the axial direction of the decompression shaft. The falling-off prevention pin is inserted in a pin insertion hole having an opening to the outer circumferential surface of the camshaft and intersecting, at least partially, the insertion hole. The opening of the pin insertion hole of the camshaft is blocked by the bearing, and the movement of the bearing in the axial direction of the camshaft is restricted by a bearing-restrict portion in the swing portion. The bearing-restrict portion is formed so as to protrude towards the bearing.

According to an embodiment of the present invention, a decompressor for an internal combustion engine is provided wherein the decompression shaft is biased in a direction of rotation by a spring with its first end locked with the camshaft and its second end locked with the swing portion. In a state where the swing portion biased by the spring is brought into contact with a stopper portion sticking out of an end face of the camshaft, the distance from the bearing located at a predetermined position to the bearing-restriction portion is smaller than a distance which the bearing located at the predetermined position moves in the axial direction of the camshaft to open completely the opening of the pin insertion hole formed in the camshaft.

According to an embodiment of the present invention, a decompressor is provided for an internal combustion engine wherein when the decompression shaft rotates against the biasing force of the spring, the restriction imposed by the bearing-restriction portion to the movement of the bearing in the axial direction of the decompression shaft is cancelled.

According to an embodiment of the present invention, a decompressor is provided for an internal combustion engine wherein the emerging-and-submerging decompression portion is a decompression plunger inserted into a plunger housing hole. The plunger housing hole communicatively connects with a deep portion of the insertion hole of the camshaft and has an opening to the cam face of the valve-moving cam.

The decompression cam is formed at an end portion of the decompression shaft. The decompression cam of the decompression shaft engages with a recessed portion formed in the decompression plunger that is housed in the plunger housing hole.

In the decompressor for an internal combustion engine according to an embodiment of the present invention, the falling-off prevention pin engages with the decompression shaft that is inserted and fitted into the insertion hole. The bearing blocks the opening of the pin insertion hole into which the falling-off prevention pin is inserted. The bearing-restriction portion restricts the movement of the bearing in the axial direction of the camshaft. Accordingly, the bearing continues to prevent the falling-off prevention pin from dropping off and the movement of the decompression shaft continues to be restricted until the bearing-restriction portion cancels its restriction to the movement of the bearing. For this reason, when, for example maintenance work is carried out, the decompression shaft and the like are prevented from dropping off. As a consequence, the maintenance work and the like can be carried out under favorable conditions with a simple configuration.

In the decompressor for an internal combustion engine according to an embodiment of the present invention, when the engine is not in operation as in a case of maintenance work or the like, the spring biases the swing portion so that the swing portion stays in contact with the stopper portion that protrudes from the end face of the camshaft. In this case, the distance from the bearing located at a predetermined position to the bearing-restriction portion of the decompression-action member is smaller than the distance for the bearing located at the predetermined position to move enough in the axial direction of the camshaft to open completely the opening of the pin insertion hole formed in the camshaft. Accordingly, when the camshaft is removed from the cylinder head during the maintenance work, even the movement of the bearing that is under the restriction imposed by the bearing-restriction portion does not open completely the opening of the pin insertion hole. The dropping-off of the falling-off prevention pin never takes place, so that the decompression shaft is prevented from dropping off.

In the decompressor for an internal combustion engine according to an embodiment of the present invention, the rotation of the decompression shaft against the biasing force of the spring cancels the restriction imposed by the bearing-restriction portion to the movement of the bearing in the axial direction of the camshaft. Accordingly, the decompression shaft can be easily removed when it is necessary for the purpose of maintenance work or the like.

In the decompressor for an internal combustion engine according to an embodiment of the present invention, the emerging-and-submerging decompression portion is the decompression plunger inserted into the plunger housing hole. The plunger housing hole communicatively connects with the deep portion of the insertion hole of the camshaft and has the opening to the cam face of the valve-moving cam. The decompression cam is formed at the end portion of the decompression shaft. The decompression cam of the decompression shaft engages with the recessed portion formed in the decompression plunger that is housed in the plunger housing hole. Accordingly, even when the decompression plunger as the emerging-and-submerging decompression portion is provided as a body that is independent of the decompression shaft, the movement of the decompression shaft is restricted. Consequently, the engagement of the decompression cam of the decompression shaft with the recessed portion formed in the decompression plunger is maintained, so that the decompression plunger is prevented from dropping off. As a result, maintenance work and the like can be carried out under favorable conditions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinbelow, an embodiment of the present invention will be described with reference to FIGS. 1 to 14.

An internal combustion engine E that is equipped with a decompressor 40 of this embodiment is a single-cylinder four-stroke internal combustion engine that is mounted on a motorcycle.

Figure 1:
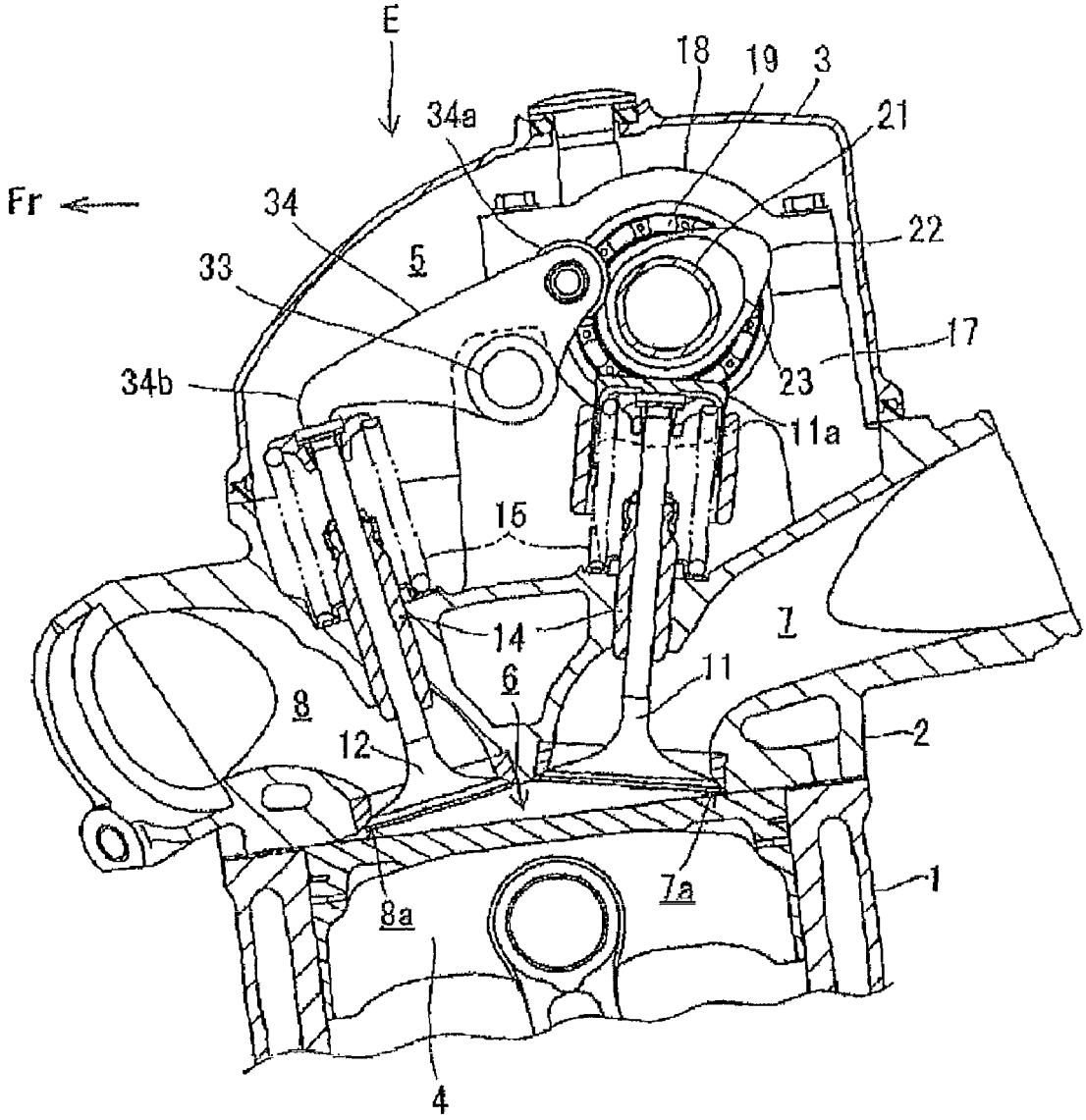
FIG. 1 is a sectional view of a cylinder head and its near-by areas of an internal combustion engine that employs a decompressor according to an embodiment of the present invention.
Figure 2:
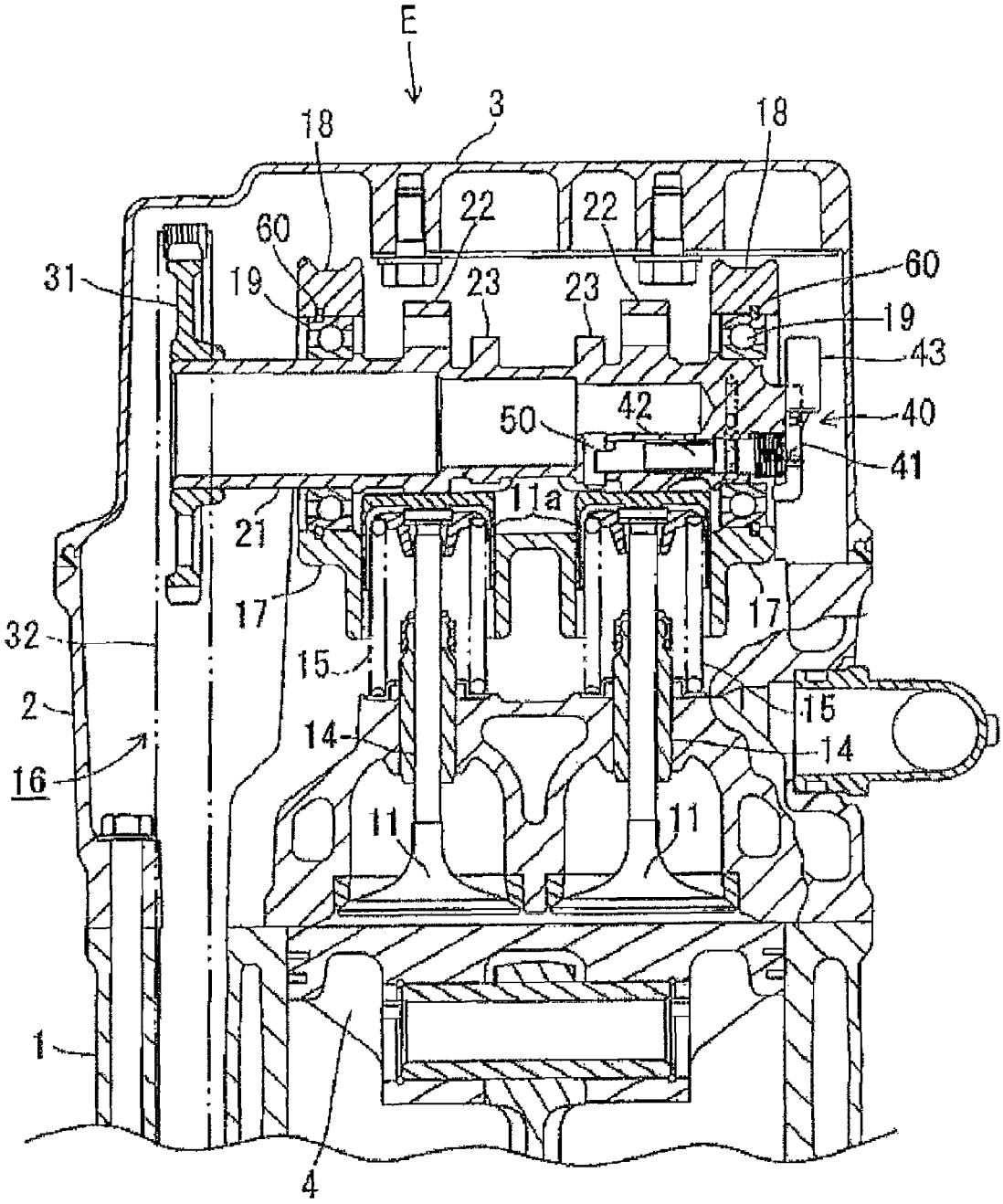
FIG. 2 is another sectional view of the cylinder head and its near-by areas of the internal combustion engine taken along another cutting line.

Referring to FIGS. 1 and 2, the internal combustion engine E includes an engine main body. The engine main body in turn includes a cylinder 1. A piston 4 is fitted into the cylinder 1 and is capable of reciprocating in the cylinder 1. The engine main body also includes a cylinder head 2 and a head cover 3. The cylinder head 2 is coupled to the upper end of the cylinder 1 while the head cover 3 is coupled to the upper end of the cylinder head 2.

The cylinder head 2 and the head cover 3 together form a valve chamber 5 in which a valve system 20 is installed. The valve system 20 is an over-head camshaft type valve system with which the internal combustion engine E is equipped.

A combustion chamber 6, an intake port 7, and an exhaust port 8 are formed in the cylinder head 2. The combustion chamber 6 is formed at a position facing the piston 4 in the axial direction of the cylinder. The intake port 7 has a right and left pair of intake mouths 7*a*, 7*a*, which have their respective openings to the combustion chamber 6. Likewise, the exhaust port 8 has a right and left pair of exhaust mouths 8*a*, 8*a*, which have their respective openings to the combustion chamber 6.

In the internal combustion engine E, which is mounted on the motorcycle with its camshaft being aligned transversely to the vehicle body, the exhaust mouths 8*a*, 8*a* are positioned on the front side, and the intake mouths 7*a*, 7*a* are positioned on the rear side.

A right and left pair of poppet valves are disposed on the rear side as intake valves 11, 11 to open and close the respective ones of the two intake mouths 7*a*, 7*a*. Likewise, a right and left pair of poppet valves are disposed on the front side as exhaust valves 12, 12 to open and close the respective ones of the two exhaust mouths 8*a*, 8*a*. In addition, a spark plug 13 is disposed so as to face the center of the combustion chamber 6 (see FIG. 3).

Valve guides 14 are pressed to fit into the cylinder head 2. The engine valves, the intake valves 11, 11 and the exhaust valves 12, 12, are inserted and fitted into their respective valve guides 14 while being allowed to slide freely. The engine valves thus inserted are always biased by the spring force of their respective valve springs towards a side such as to close the engine valves.

The valve system 20 moves the intake valves 11, 11 and the exhaust valves 12, 12. The intake port 7 and the exhaust port 8 have their respective openings to the combustion chamber 6. In synchronization with the revolution of the engine, the intake valves 11, 11 open and close the intake port 7 while the exhaust valves 12, 12 open and close the exhaust port 8.

Figure 3:
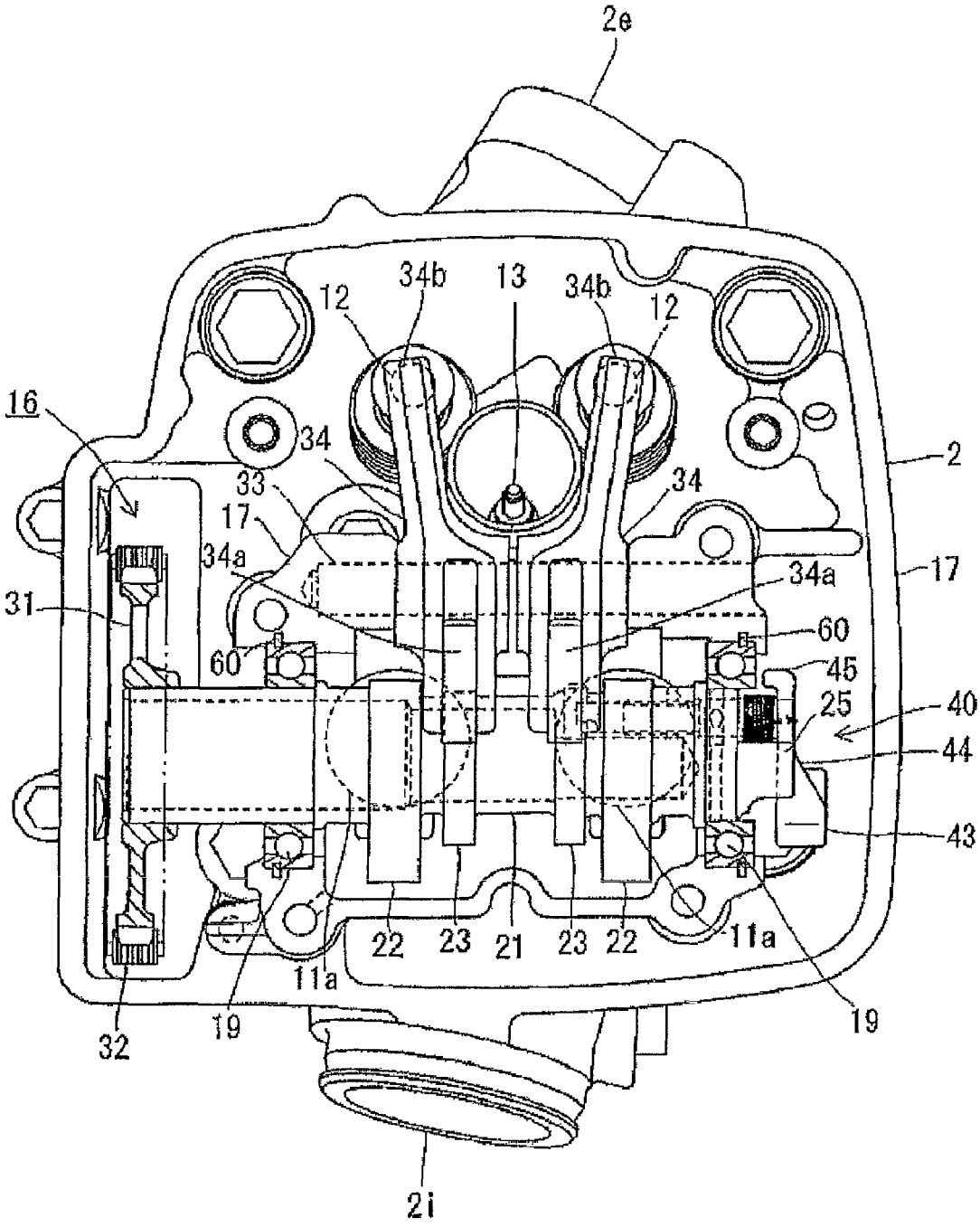
FIG. 3 is a top plan view of the cylinder head illustrating, with a cylinder head cover being removed, the internal structure of the cylinder head.

Referring to FIG. 3, a top plan view of a cylinder head 2 illustrates the inside structure of the cylinder head 2 with the cylinder head cover 3 being removed therefrom. In the valve chamber 5, in which the valve system 20 is installed, a right and left pair of bearing walls 17, 17 are formed so as to extend from the cylinder head 2. The pair of bearing walls 17, 17 face each other with the right and left pair of intake valves 11, 11 located in between. Further at the left-hand side of the left-hand side bearing wall 17, a chain chamber 16, which has its longitudinal side aligned in the front-to-rear direction of the vehicle body, is formed so as to penetrate the cylinder head 2 in the up-to-down direction.

The top surface of each of the right and the left bearing walls 17, 17 is formed into a semi-circular arched shaft-supporting portion while a semi-circular arched shaft-support portion is formed in each of camshaft holders 18, 18. A ball bearing is held by and between each of the shaft-support portions of the bearing walls 17, 17 and the corresponding one of the shaft-support portions of the camshaft holders 18, 18. The ball bearings thus held, bearings 19, 19, support a camshaft 21 and the camshaft thus supported is capable of rotating freely.

The camshaft 21 is thus supported so as to be oriented in the right-to-left direction of the vehicle body. On the camshaft 21, a pair of valve-moving cams, intake cam lobes 22, 22, are formed between the right and the left bearings 19, 19 so as to correspond to the right and the left intake valves 11, 11. In addition, another pair of valve-moving cams, exhaust cam lobes 23, 23, are formed between the right and the left intake cam lobes 22, 22. The left end portion of the camshaft 21 extends beyond the left-hand side bearing 19 into the chain chamber 16, and a driven chain sprocket 31 is attached to the left end portion thus sticking out.

Though not illustrated, a drive chain sprocket is attached to the crankshaft. A timing chain 32 is looped between the drive chain sprocket and the driven chain sprocket 31. The power of the crankshaft is transmitted by the timing chain 32 to the camshaft 21, while the revolution of the crankshaft is reduced by half.

Valve lifters 11*a*, 11*a* are provided to cover above the respective intake valves 11, 11. Each of the intake cam lobes 22, 22 formed on the camshaft 21 is in contact with the top surface of the corresponding one of the valve lifters 11*a*, 11*a*. The rotation of the camshaft 21 drives the intake cam lobes 22, 22 to directly open and close the respective intake valves 11, 11 with a predetermined lift amount and at a predetermined open-and-close timing.

At the front side of the camshaft 21, a rocker-arm shaft 33 is provided so as to extend between the right and the left bearing walls 17, 17 as well as to be parallel to the camshaft 21. The rocker-arm shaft 33 pivotally supports a pair of rocker arms 34, 34. The rocker arms 34, 34 are adjacent to each other and are capable of swinging freely.

Each of the rocker arms 34, 34 extends in the front-to-rear direction. A roller 34*a* is provided at an end portion on the rear side, and the roller 34*a* is in contact with the corresponding one of the exhaust cam lobes 23, 23. Another end portion on the front side, that is, an end portion 34*b*, is in contact with the upper end of the valve stem of the corresponding one of the exhaust valves 12, 12.

With this configuration, the rotation of the exhaust cam lobes 23, 23 together with the camshaft 21 drives the rocker arms 34, 34 to open and close the exhaust valves 12, 12 with a predetermined lift amount and at a predetermined open-and-close timing.

In a side portion 2*i* of the cylinder head 2, an opening to let the air into the intake port 7 is formed, and an intake pipe of the intake system is attached to the opening. The air taken in through the intake system is mixed with the fuel supplied from a fuel supply system, such as a carburetor, to be made into the air-fuel mixture. The air-fuel mixture is taken into the combustion chamber 6 from the intake valves 11, 11 through the intake port 7 during the intake stroke, and the air-fuel mixture is compressed, as still being the state of air-fuel mixture, during the compression stroke in which the piston 4 moves up.

At the terminal period of the compression stroke, the air-fuel mixture is burned by the ignition provided by the spark plug 13. During the expansion stroke in which the piston 4 moves down, the piston 4 driven by the pressure of the combustion gas drives, in turn, the crankshaft to rotate.

The combustion gas moves, as an exhaust gas, from the combustion chamber 6 to the exhaust port 8 through the exhaust valves 12, 12 that are opened during the exhaust stroke with the piston 4 moving up. In a side portion 2*e* of the cylinder head 2, an opening to let the exhaust gas out of the exhaust port 8 is formed, and an exhaust pipe of the exhaust system is attached to the opening. The exhaust gas, which has been passed through the exhaust port, passes through the exhaust system and is let out of the internal combustion engine E.

To facilitate the starting of the internal combustion engine E with a smaller operational power, the compressed pressure within the combustion chamber 6 has to be released. For this purpose, the internal combustion engine E is equipped with a decompressor 40 provided in the camshaft 21.

Referring to FIGS. 5 and 8 to 10, the camshaft 21 has a cylindrical shape having a bottom. A large-diameter circular hole 21*a* includes an opening at the left-hand side end, a medium-diameter circular hole 21*b*, and a small-diameter circular hole 21*c* that are consecutively formed from the left-hand side rightwards. The right-hand side end of the camshaft 21 is closed.

The small-diameter circular hole 21 alone is formed eccentrically to the rotational axis of the camshaft 21.

A columnar bottom portion 24 is provided to close the right-hand side end of the camshaft 21, and a flange 24*f* is formed at the left-hand side of the columnar bottom portion 24. A bearing 19 is fitted onto the outer circumferential surface of the columnar bottom portion 24.

On the end face of the columnar bottom portion 24, a stopper portion 25 is formed. The stopper portion is shaped in a sector of approximately 90-degree center angle, and protrudes to the right. The other 270-degree portion of end face of the columnar bottom portion 24 than the 90-degree stopper portion 25 is formed into a flat end face 24*a* (see FIGS. 9 and 10).

The two paired side surfaces of the sector-shaped, protruding stopper portion 25 are stopper faces 25*a* and 25*b*.

Figure 8:
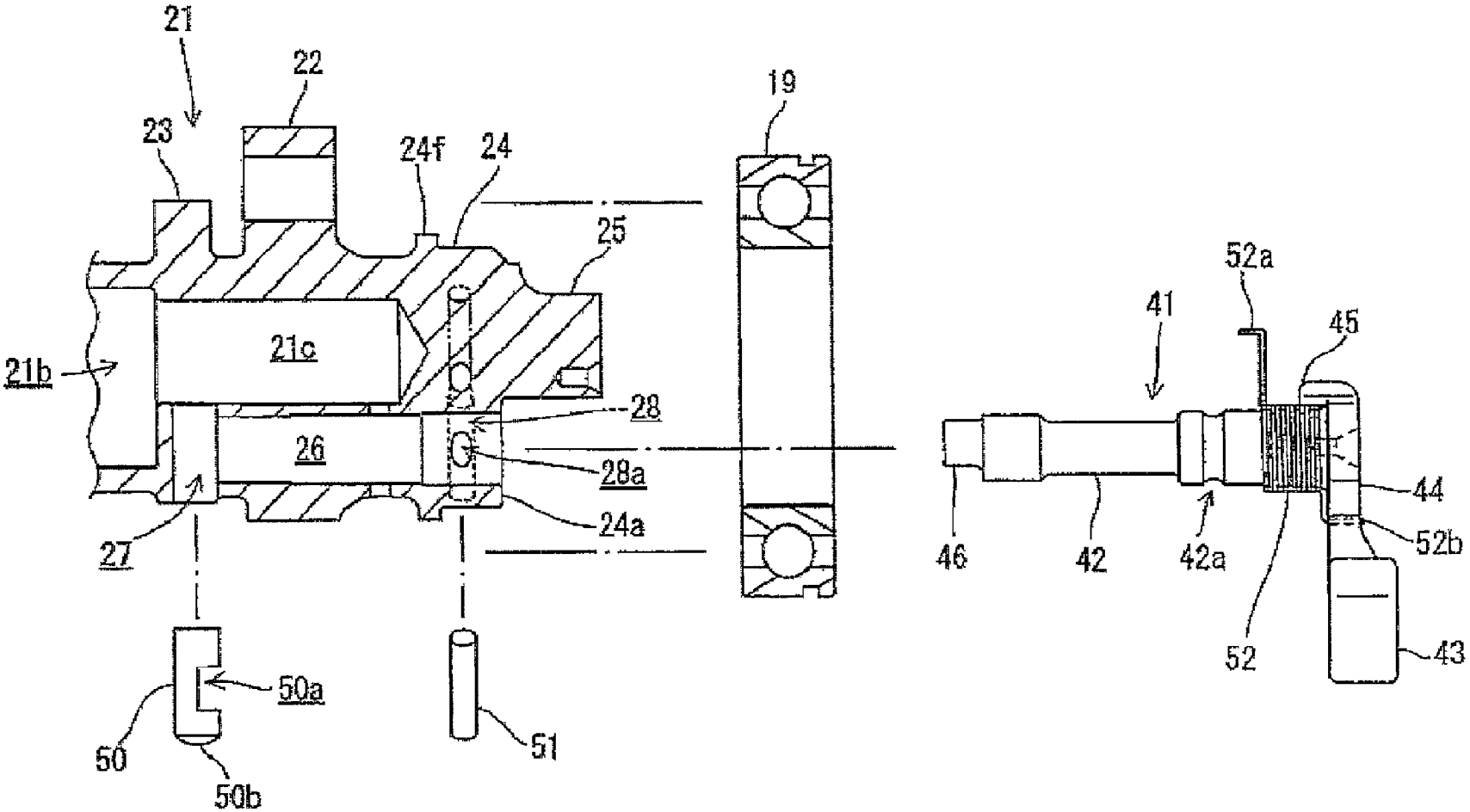
FIG. 8 is an exploded sectional view of the decompressor.
Figure 9:
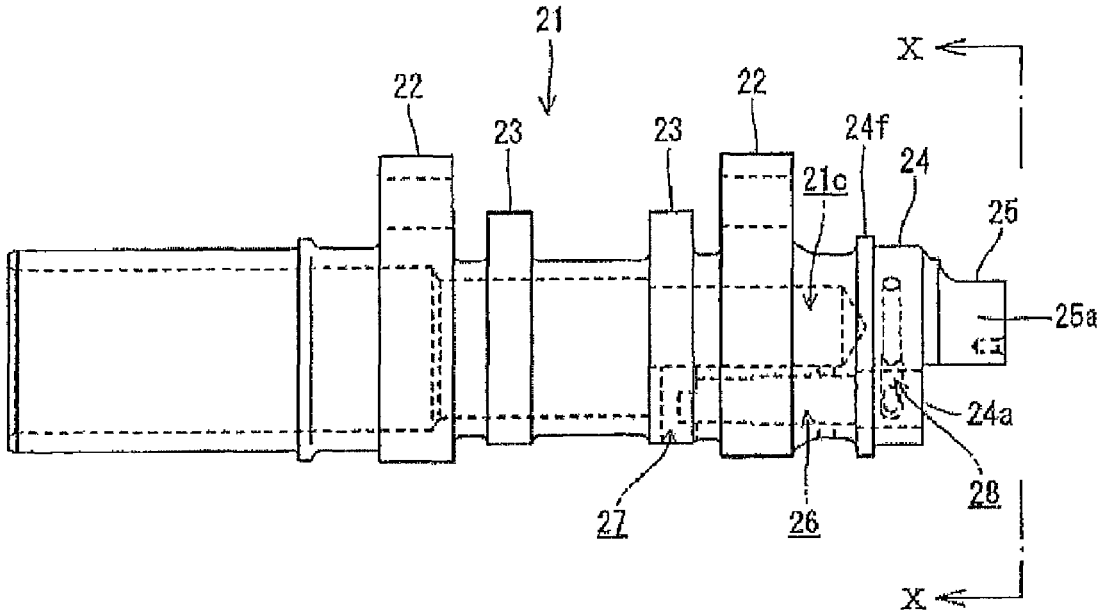
FIG. 9 is a top plan view of the camshaft.
Figure 10:
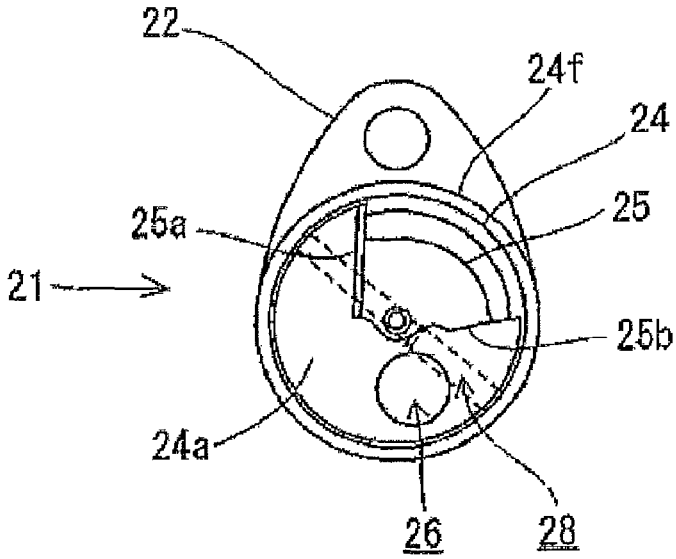
FIG. 10 is a right-hand side view of the camshaft.
Figure 11:
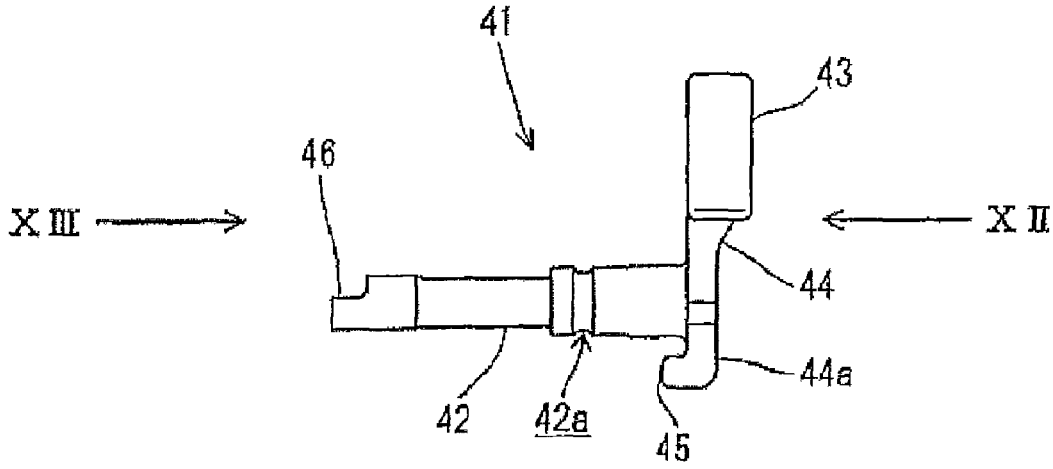
FIG. 11 is a top plan view of a decompression-action member.
Figure 12:
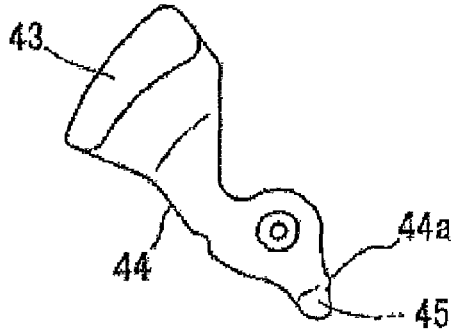
FIG. 12 is a right-hand side view of the decompression-action member.
Figure 13:
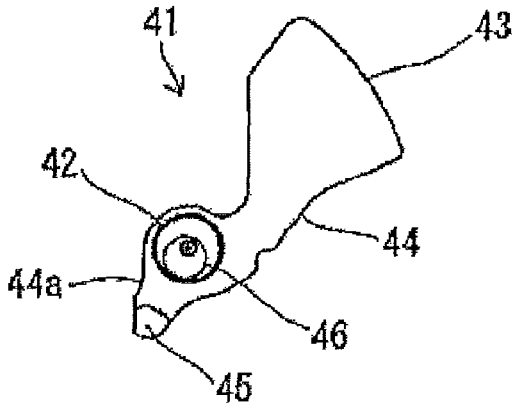
FIG. 13 is a left-hand side view of the decompression-action member.

Referring to FIG. 8, an insertion hole 26 includes an opening in the end face 24*a* of the columnar bottom portion 24 that is drilled so as to be eccentric to the rotational axis and to be parallel with the small-diameter circular hole 21*c*, that extends in the axial direction. The insertion hole 26 is thus drilled at a depth in the axial direction so as to nearly reach the right-hand side of one of the exhaust cam lobes 23, 23.

A decompression shaft 42, which will be described later, is inserted into the insertion hole 26, and is thus allowed to rotate freely.

Figure 4:
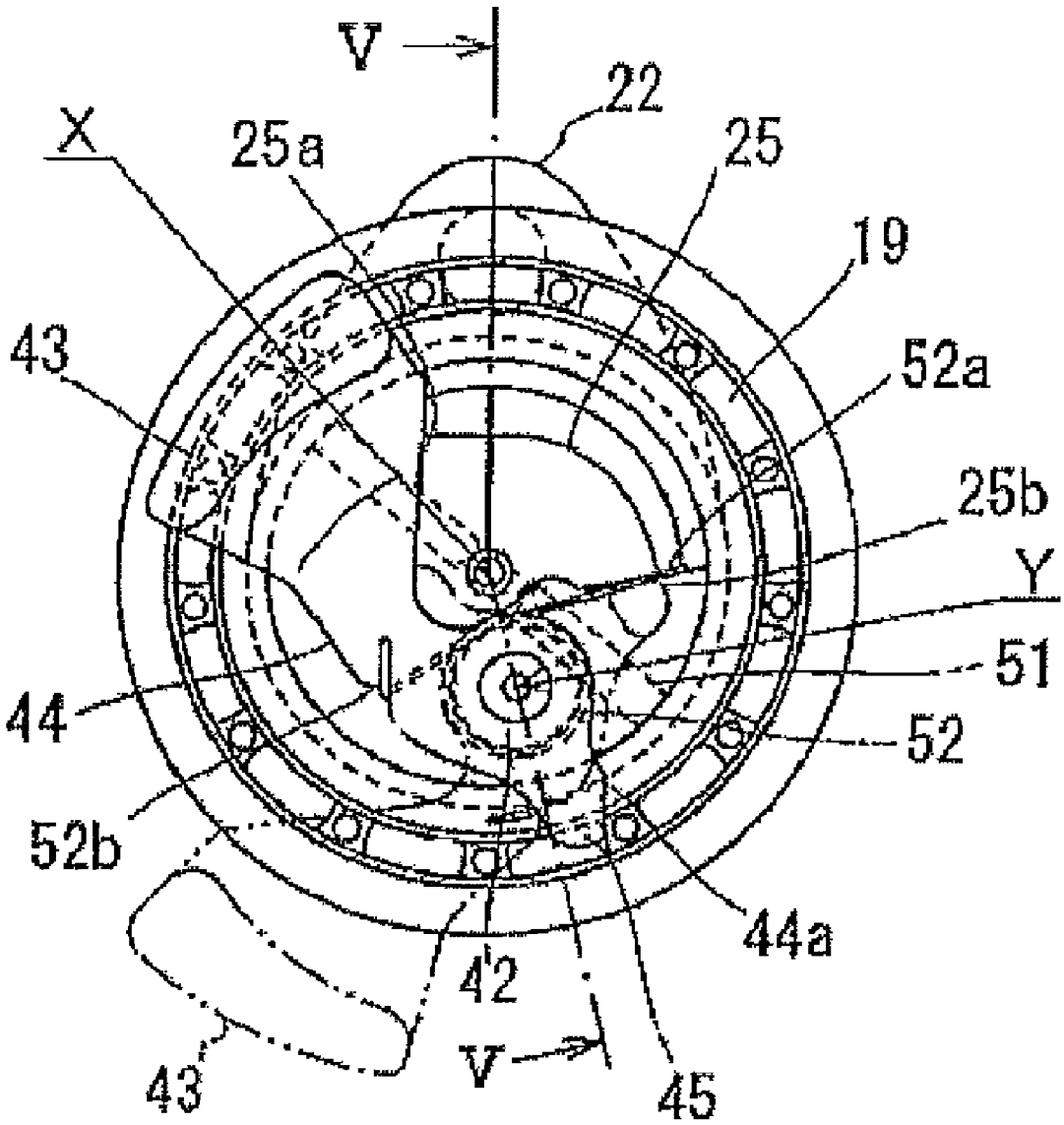
FIG. 4 is a right-hand side view of a camshaft in a state where no external force is applied to a decompression weight (decompressing state) when viewed in the axial direction of the camshaft.
Figure 5:
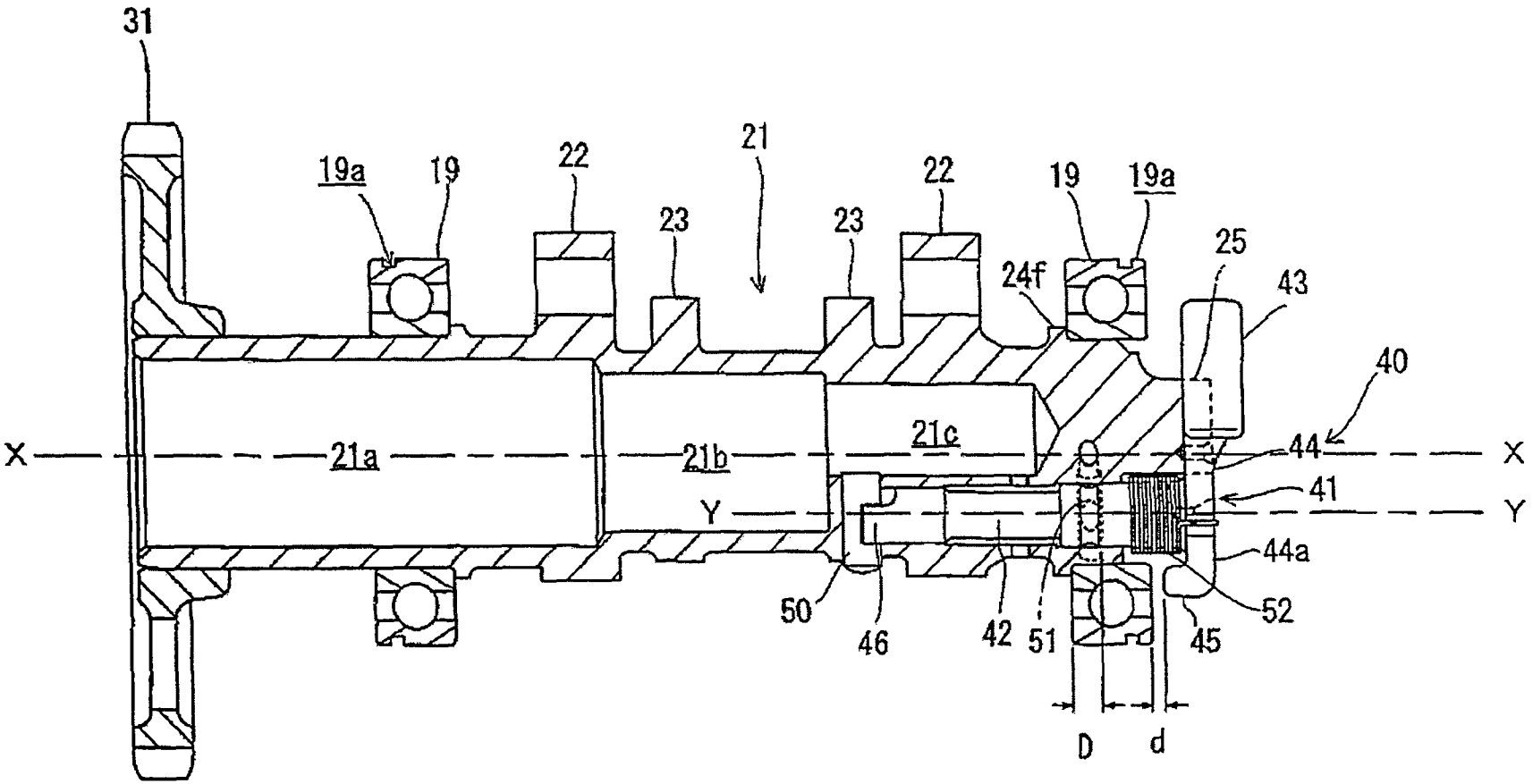
FIG. 5 is a sectional view taken along the line V-V in FIG. 4.

As a consequence, the rotational axis of the decompression shaft 42, which is represented by Y in FIGS. 4 and 5, is located at a position so as to be eccentric to the rotational axis X of the camshaft 21.

In the meanwhile, a plunger housing hole 27 that has an opening in the cam face of the right-hand side one of the exhaust cam lobes 23, 23 is drilled so as to reach the small-diameter circular hole 21. The insertion hole 26 reaches a deeper portion of the plunger housing hole 27 so that the two holes 26 and 27 are orthogonal to each other.

A decompression plunger 50, which will be described later, is inserted into the plunger housing hole 27, and is thus allowed to emerge from and submerge down into the plunger housing hole 27.

A pin insertion hole 28 with a small diameter is formed as penetrating the columnar bottom portion 24 in the direction of a diameter passing on the center of the columnar bottom portion 24. The pin insertion hole 28 is open to the outer circumferential surface of the columnar bottom portion 24.

In the pin insertion hole 28, a portion extending from the center to a side has a slightly smaller diameter than the other portion. The portion of the insertion hole 28 with a larger diameter partially intersects the insertion hole 26 (see FIG. 10). An opening 28*a* illustrated in the sectional view of the camshaft 21 of FIG. 8 is formed inside the insertion hole 26 and is communicatively connected to the pin insertion hole 28.

A falling-off prevention pin 51 is inserted into the larger-diameter portion of the pin insertion hole 28, which intersects the insertion hole 26.

The falling-off prevention pin 51 has an outer diameter that is larger than the diameter of the smaller-diameter portion of the pin insertion hole 28. Accordingly, the falling-off prevention pin 51 does not reach the smaller-diameter portion of the pin insertion hole 28. The smaller-diameter portion of the pin insertion hole 28 is used to remove the falling-off prevention pin 51 that has been inserted in the larger-diameter portion of the pin insertion hole 28.

The decompressor 40 is assembled to the camshaft 21 with a structure described above.

A decompression-action member 41, which is a main component of the decompressor 40, has a shape illustrated in FIGS. 11 to 14.

The decompression-action member 41 is composed of a decompression shaft 42, a swing portion 44, and a decompression cam 46. The decompression shaft 42 is inserted and fitted into the insertion hole 26. The swing portion 44 is formed at an end of the decompression shaft 42, and has a decompression weight 43 extending in a radial direction. The decompression cam 46 with a columnar shape protrudes from the other end of the decompression shaft 42, while the decompression cam 46 and the decompression shaft 42 are eccentric relative to each other.

Figure 14:
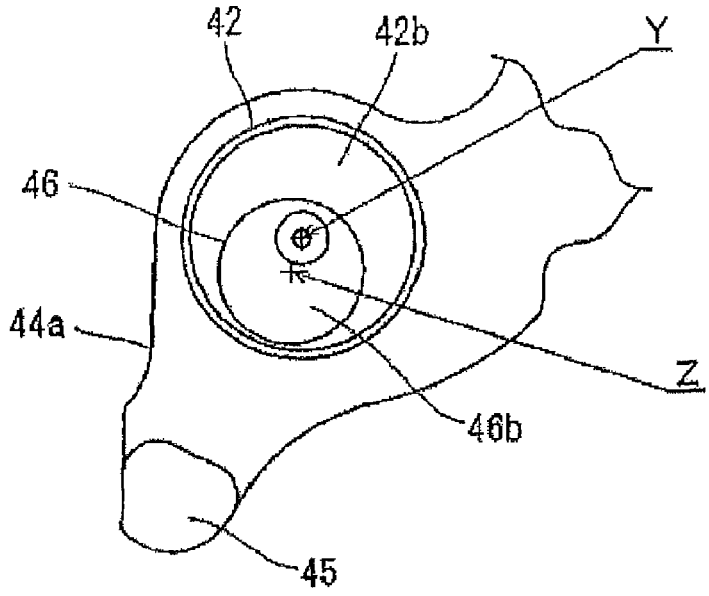
FIG. 14 is an enlarged left-hand side view of the decompression shaft.

FIG. 14 shows that the decompression cam has a central axis Z positioned eccentrically to the rotational axis Y of the decompression shaft 42.

The decompression shaft 42 is formed with its portion closer to the swing decompression shaft 42. A stripe groove 42*a* is formed in the larger-diameter portion at a predetermined position in the axial direction while extending in the circumferential direction of the decompression shaft 42 to circle all around the circumference of the larger-diameter portion.

In the swing portion 44, the decompression weight 43 is formed as a portion extending in a radial direction to a greater degree. Meanwhile the portion slightly extending in the opposite radial direction is formed into an extending portion 44*a*. At the tip end of the extending portion 44*a*, a bearing-restriction portion 45 is formed so as to protrude in the axial direction of the decompression shaft 42 to the side of the decompression shaft 42.

The decompression cam 46 is a columnar portion that protrudes from a circular-shaped end face 42*b* of the decompression shaft 42. The diameter of the decompression cam 46 is smaller than that of the circular-shaped end face 42*b*. The decompression cam 46 is made eccentric to the decompression shaft 42 in a substantially opposite direction to the direction in which the decompression weight 43 extends. As shown in FIG. 14, which is a view seen in the axial direction, the decompression cam 46 is positioned so that the entire part of circular-shaped end face 46*b* of the decompression cam 46 can be located within the area of the circular-shaped end face 42*b* of the decompression shaft 42.

The decompression plunger 50 is inserted and fitted into the plunger housing hole 27, which has an opening formed in the cam lobe 23 of the camshaft 21. The decompression plunger 50 is a columnar member with a length that is approximately equal to the length of the plunger housing hole 27. In the circumferential surface of the decompression plunger, a recessed groove 50*a* is formed at a predetermined position. In addition, one of the end portions of the decompression plunger 50 is formed into a spherical surface 50*b* (see FIG. 8). The decompression plunger 50 has the spherical surface 50*b* formed in the end portion that emerges above and submerges below the cam face of the exhaust cam lobe 23 when the decompression plunger 50 is inserted and fitted into the plunger housing hole 27.

The pin insertion hole 28 is formed in the columnar bottom portion 24 of the camshaft 21 so as to penetrate the columnar bottom portion 24 in the direction of a diameter. The falling-off prevention pin 51 that is inserted into the pin insertion hole 28 is a columnar pin, and has an equal length to that of the pin insertion hole 28. When the falling-off prevention pin 51 is inserted into the pin insertion hole 28, a part of the falling-off prevention pin 51 appears inside the insertion hole 26 from the opening 28*a* that is formed to face the insertion hole 26.

In addition, a torsion spring 52 is set so as to be wrapped around the base portion of the decompression shaft 42. To the base portion the decompression shaft 42 is attached to the swing portion 44.

The above-described parts of the decompressor 40 are assembled to an end portion of the camshaft 21.

The decompression plunger 50 is inserted and fitted into the plunger housing hole 27, while the decompression shaft 42 is inserted and fitted into the insertion hole 26. Thereafter, the decompression cam 46 formed at the end of the decompression shaft 42 engages with the recessed groove 50*a* formed in the decompression plunger 50.

When the decompression shaft 42 is inserted, to a predetermined position, into the insertion hole 26, the stripe groove 42*a* formed in the decompression shaft 42 is positioned so as to align with the position of the pin insertion hole 28 in the axial direction of the decompression shaft 42. Accordingly, when the falling-off prevention pin 51 is inserted into the pin insertion hole 28, the part of the falling-off prevention pin 51, the part that appears from the opening 28*a* facing the insertion hole 26, engages with the stripe groove 42*a* formed in the outer circumferential surface of the decompression shaft 42. As a result, the decompression shaft 42 is prevented from moving in the axial direction of the decompression shaft 42.

Here, the falling-off prevention pin 51 engages tangentially with the ring-shaped stripe groove 42*a* of the decompression shaft 42, so that the decompression shaft 42 is allowed to rotate.

The pin insertion hole 28, into which the falling-off prevention pin 51 is of the columnar bottom portion 24. Each of the openings thus formed is blocked up by the bearing 19 that is fitted onto the columnar bottom portion 24.

Accordingly, the bearing 19 prevents the falling-off prevention pin 51 from falling off. The falling-off prevention pin 51 thus prevented from falling off maintains the engagement with the decompression shaft 42, and prevents the decompression shaft 42 from falling off from the insertion hole 26 (see FIG. 5).

When the decompression shaft 42 is inserted, to a predetermined position, into the insertion hole 26, the swing portion 44 faces the end face 24*a* of the camshaft 21 with the torsion spring located in between while located at the same position as that of the stopper portion 25 in the axial direction of the decompression shaft 42.

The torsion spring 52 that is set to be wrapped around the decompression shaft 42 has a first end 52*a* locked with the outer circumference of the stopper portion 25 of the camshaft 21 and a second end 52*b* locked with the swing portion 44 of the decompression-action member 41. Consequently, the swing portion 44 is biased clockwise in FIG. 5.

As a result, when the camshaft 21 does not move, the swing portion 44 of the decompression-action member 41 is brought into contact with the stopper face 25*a* of the stopper portion 25 by the biasing force of the torsion spring 52 (see FIG. 4).

While the swing portion 44 is in a swing state described above, the rotational position of the decompression shaft 42 positions the eccentric decompression cam 46 on an outer side of the camshaft 21. Consequently, the decompression plunger 50 that engages with the decompression cam 46 is made to stick out of the cam face of the exhaust cam lobe 23. To put it other way, the decompression plunger 50 is made to be positioned at decompressing position (see FIG. 5).

In this state, the decompression weight 43 of the swing portion 44 stays at a position so that the bearing 19 overlaps the decompression weight 43 when viewed in the axial direction. In addition, the bearing-restriction portion 45 at the tip end of the extending portion 44*a*, which extends out to a substantially opposite side to the decompression weight 43, faces and lie over the inner race of bearing 19 (see FIGS. 4 and 5).

With an increase in the speed of revolutions of the camshaft 21, the decompression-action member 41 makes the swing portion 44 move swinging with the centrifugal force of the decompression weight 43 against the biasing force of the torsion spring. The swing portion 44 is thus moved counterclockwise in the axial-direction views of FIGS. 4 and 6.

Figure 7:
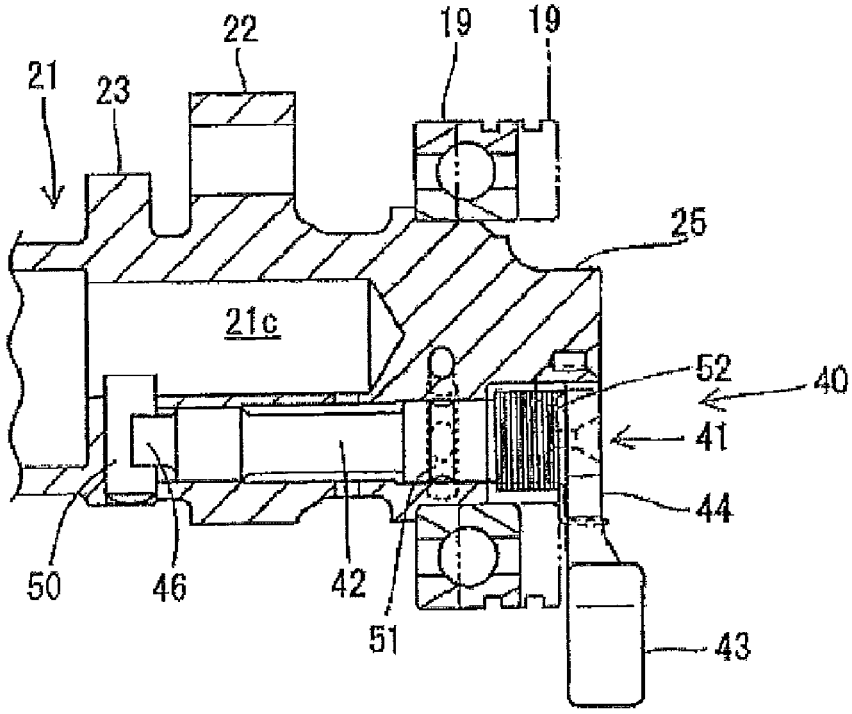
FIG. 7 is a sectional view taken along the line VII-VII in FIG. 6.

In this event, as FIG. 7 shows, the eccentric decompression cam 46 of the camshaft 21 is displaced inwards. Thereafter, the decompression plunger that engages with the decompression cam 46 is made to submerge below the cam face of the exhaust cam lobe 23, and is made to be positioned at the decompression-cancelling position.

Figure 6:
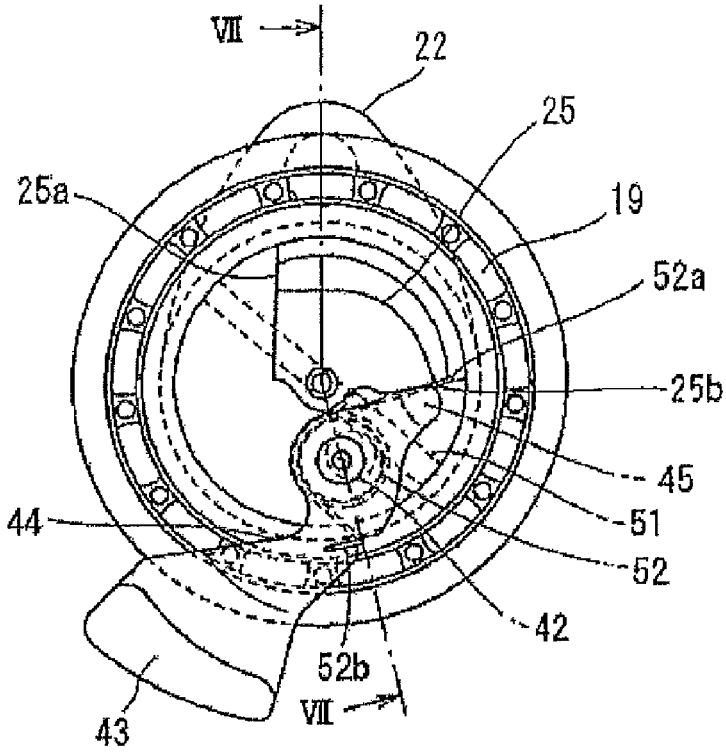
FIG. 6 is a right-hand side view of a camshaft in a state where the decompression weight is moved swinging against the spring force of the torsion spring (decompression-cancelling state) when viewed in the axial direction of the camshaft.

Supposing that the swing portion 44 is moved swinging until the extending portion 44*a* is brought into contact with the stopper face 25*a* of the stopper portion 25 as shown in FIGS. 6 and 7, in this case, the decompression weight 43 of the swing portion 44 runs outwards off the edge of the bearing 19 when viewed in the axial direction. In addition, the bearing-restriction portion 45 at the tip end of the extending portion 44*a*, which extends out to a substantially opposite side to the decompression weight 43, goes further inwards to a position that is located at the inner side of the inner race of the bearing 19 (see FIG. 6).

The decompressor 40 of this embodiment has a structure that has been described thus far. Accordingly, when the internal combustion engine E starts and revolves still slowly, the camshaft 21 rotates also slowly. As a consequence, the decompression plunger 50 sticks out of the cam face of the exhaust cam lobe 23, that is, the decompression plunger 50 is positioned at the decompressing position. The decompression plunger thus positioned opens the right-hand side one of the exhaust valves 12, 12 during the compression stroke at the start of the internal combustion engine E. Thus, the compression pressure of the combustion chamber 6 is released so that the internal combustion engine E can start smoothly.

As the engine revolutions increase after the start of the internal combustion engine E, the camshaft 21 rotates faster The decompression weight 43 rotates the decompression-action member 41 by the centrifugal force, and the decompression cam 46 makes the decompression plunger 50 submerge below the cam face of the exhaust cam lobe 23. The decompression plunger 50 is thus positioned at the decompression-cancelling position. Consequently, none of the exhaust valves 12, 12 is opened during the compression stroke, that is, the decompression-cancelling state is accomplished.

Now, suppose that the camshaft 21 with the decompressor 40 being assembled thereto is installed so as to be held by and between each of the right and the left bearing walls 17, 17 and corresponding one of the camshaft holders 18, 18 with the bearings 19, 19 interposed in between. In this state, a stopper ring 60 engages with a stripe groove 19*a* which is carved in the outer circumferential surface of the outer race of the bearing 19 and which is formed in the circumferential direction of the outer race (see FIG. 5). The stopper ring 60 also engages with a stripe groove carved in the inner circumferential surface of each bearing wall 17 and in each camshaft holder 18. In such a state, as the one shown in FIG. 2, the bearing 19 is prevented from moving in the axial direction of the camshaft 21.

When maintenance work is carried out for the valve system of the internal combustion engine E, the camshaft 21 is sometimes taken out of the position by removing the camshaft holders 18, 18. In this event, the engagement of the stopper rings 60, 60 is cancelled, so that the bearing 19 become movable relative to the camshaft 21 in the axial direction thereof.

Supposing a particular case wherein the right-hand side one of the bearings 19, 19 moves rightwards relative to the camshaft 21 and drops off from the columnar bottom portion 24. In this case, the opening of the pin insertion hole 28, which is formed in the outer circumferential surface of the columnar bottom portion 24, becomes unblocked, and the falling-off prevention pin 51 drops off from the pin insertion hole 28. Consequently, the engagement of the falling-off prevention pin 28 with the decompression shaft 42 is cancelled, and thus the decompression shaft 42 drops off from the insertion hole 26.

Supposing a case wherein no external force is applied to the swing portion 44 of the decompression-action member 41 in the decompressor 40 of this embodiment. In this case, the decompressor 40 is in a state shown in FIG. 5. More specifically, the biasing force of the torsion spring 52 brings the swing portion 44 of the decompressor 40 into contact with the stopper face 25*a* of the stopper portion 25.

In this state, a distance d and a distance D shown in FIG. 5 have a relationship such that the distance d is smaller than the distance D. Here, the distance d is the distance from the bearing 19, which is located at a predetermined position of the columnar bottom portion 24, to the bearing-restriction portion 45 that protrudes leftwards from the tip end of the extending portion 44*a* of the decompression-action member 41. On the other hand, the distance D is the distance for the bearing 19, which is located at the predetermined position, to move to the right in the axial direction of the camshaft 21 so that the opening of the pin insertion hole 28 having been blocked by the bearing 19 can be completely opened.

Accordingly, even when the bearing 19 moves to the right relative to the camshaft 21 (note that the movement to the left is restricted by the flange 24*f*), the bearing-restriction portion 45 of the swing portion 44 does not allow the bearing 19 to move enough to open completely the opening of the pin insertion hole 28. As a consequence, the falling-off prevention pin 51 never drops off from the pin insertion hole 28, and thus the engagement of the falling-off prevention pin 51 with the decompression shaft 42 is maintained. For this reason, the dropping-off of the decompression shaft 42 never takes place.

The prevention of the dropping-off of the decompression shaft 42 allows maintenance work to be carried out under favorable conditions.

Referring to FIGS. 6 and 7, when the decompressor 40 of this embodiment is disassembled, the swing portion 44 of the decompression-action member 41 is moved swinging against the spring force of the torsion spring 52 until the bearing-restriction portion 45 at the tip end of the extending portion 44*a* reaches the inside of the bearing 19. In this case, the bearing 19 can move to the right relative to the camshaft 21 with no restriction imposed by the bearing-restriction portion 45 that protrudes to the left. The bearing 19 can move at a position indicated by the two-dot chain lines in FIG. 7, so that the opening of the pin insertion hole 28 is completely opened. Accordingly, the falling-off prevention pin 51 can be removed through the opening of the pin insertion hole 28 thus opened completely. Now that the decompression shaft 42 is thus disengaged from the falling-off prevention pin 51, the decompression shaft 42 can be removed from the insertion hole 26.

In addition, the removing of the decompression shaft 42 cancels the engagement of the decompression shaft 42 with the decompression plunger 50, so that the decompression plunger 50 can also be removed.

The assembling of the decompressor 40 to the camshaft 21 can be accomplished by processes in the opposite order to that described above.

As has been described above, according to the decompressor 40 of this embodiment, favorable conditions for carrying out maintenance work can be achieved with a simple structure by use of the bearing 19 and the swing portion 44 including the decompression weight 43. The favorable conditions are achieved by the restriction imposed by the bearing-restriction portion 45 of the swing portion 44 on the movement of the bearing 19.

In the embodiment described thus far, the decompression plunger 50 is provided as an emerging-and-submerging decompressor member, that is, as a body that is independent of the decompression shaft 42. The present invention, which aims to prevent the dropping-off of the decompression shaft at the maintenance work, can alternatively be carried out by a configuration in which an emerging-and-submerging decompressor portion formed integrally with the decompression shaft.

Figure 15:
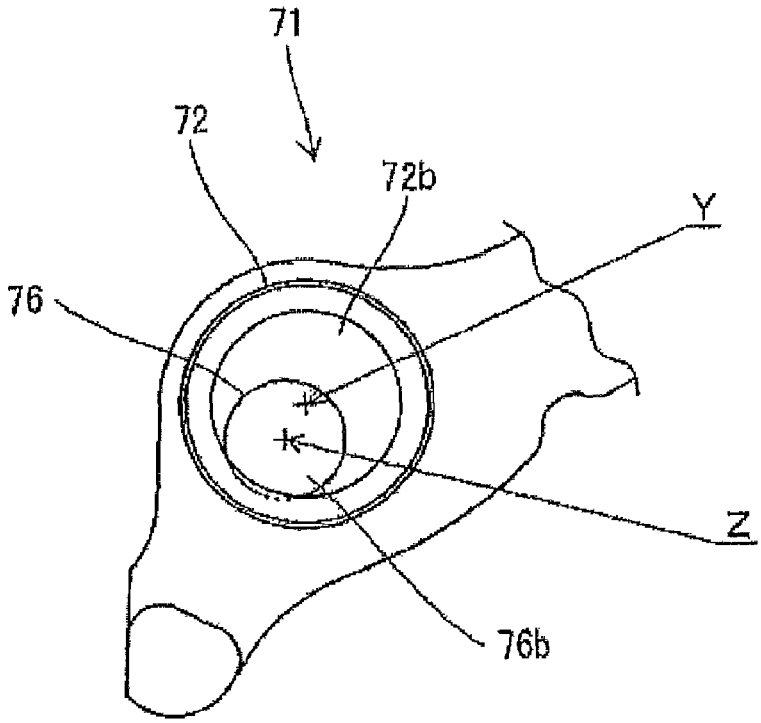
FIG. 15 is an enlarged left-hand sided view of a decompression shaft of another example.

In addition, as shown in FIG. 14, the decompression cam 46 of the decompression shaft 42, which makes the decompression plunger 50 emerge and submerge, protrudes eccentrically to the circular-shaped end face 42*b* of the decompression shaft 42. Moreover, when viewed in the axial direction of the decompression shaft 42, the decompression cam 46 is positioned so that the entire part of circular-shaped end face 46*b* of the decompression cam 46 can be located within the area of the circular-shaped end face 42*b* of the decompression shaft 42. However, FIG. 15 shows another possible example of a decompression-action member 71. In this example, a decompression cam that eccentrically protrudes from a circular-shaped end face 72*b* of a decompression shaft 72 has a quasi-columnar shape with a part thereof being cut away (note that the decompression cam has a central axis Z that is eccentric to the rotational axis Y of the decompression shaft 72). When viewed in the axial direction of the decompression shaft 72, the decompression cam 76 has a circular-shaped end face 76*b* with an imaginary perfect circle that runs off the edge of the circular-shaped end face 72*b* of the decompression shaft 72.

The running-off portion can be formed by cutting away simultaneously when the circular-shaped end face 72*b* of the decompression shaft 72 is processed with the rotational axis Y being set as the center This simple processing can form, with accuracy, an insensitive area that does not make the decompression plunger operate. In addition, with this simple processing, the decompression cam 76 can be located within the area of the circular-shaped end face 72*b* of the decompression shaft 72 when viewed in the axial direction of the decompression shaft 72. Accordingly, while the insertion of the decompression shaft 72 into the insertion hole is facilitated, the decompression plunger that engages with the decompression cam 76 can be made to emerge and submerge as in the embodiment described above.

In summary, the circular-shaped end face 76*b* of the decompression cam 76 can be processed more accurately in relation to the rotational axis Y of the decompression shaft 72, and the decompression plunger 50 is made to emerge by an amount that is more accurately controlled.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A decompressor for an internal combustion engine, the decompressor performing decompression and cancelling the decompression by moving a decompression shaft relative to a camshaft to make an emerging-and-submerging decompression portion of the decompression shaft emerge above and submerge below a cam face of a valve-moving cam formed on the outer circumferential surface of the camshaft, the decompression shaft being supported so as to be rotatable freely, and the camshaft being supported by a bearing so as to be rotatable freely and driving an engine valve by use of the valve-moving cam, wherein the decompression shaft is inserted and fitted into an insertion hole of the camshaft so as to be rotatable relative to the camshaft, the insertion hole having an opening in a first end face of the camshaft and drilled in the axial direction of the camshaft at a position eccentric to the rotational axis of the camshaft;

a swing portion is provided at a first end of the decompression shaft, and extends along the first end face of the camshaft in a radial direction of the decompression shaft;

by engaging a falling-off prevention pin with the decompression shaft while allowing the decompression shaft to rotate, the decompression shaft is prevented from moving in the axial direction of the decompression shaft, the falling-off prevention pin being inserted in a pin insertion hole of the camshaft having an opening to the outer circumferential surface of the camshaft and intersecting, at least partially, the insertion hole;

the opening of the pin insertion hole of the camshaft is blocked by the bearing; and the movement of the bearing in the axial direction of the camshaft is restricted by a bearing-restrict portion in the swing portion, the bearing-restrict portion formed so as to protrude towards the bearing.

2. The decompressor for an internal combustion engine according to claim 1, wherein the decompression shaft is biased in a direction of rotational movement by a spring with its first end locked with the camshaft and its second end locked with the swing portion;

in a state where the swing portion biased by the spring is brought into contact with a stopper portion sticking out of an end face of the camshaft, the distance from the bearing located at a predetermined position, to the bearing-restriction portion is smaller than a distance which the bearing located at the predetermined position moves in the axial direction of the camshaft to open completely the opening of the pin insertion hole formed in the camshaft.

3. The decompressor for an internal combustion engine according to claim 2, wherein when the decompression shaft rotates against the biasing force of the spring, the restriction imposed by the bearing-restriction portion to the movement of the bearing in the axial direction of the decompression shaft is cancelled.

4. The decompressor for an internal combustion engine according to claim 1, wherein the emerging-and-submerging decompression portion is a decompression plunger inserted into a plunger housing hole communicatively connecting with a deep portion of the insertion hole of the camshaft and having an opening to the cam face of the valve-moving cam;

the decompression cam is formed at an end portion of the decompression shaft; and the decompression cam of the decompression shaft engages with a recessed portion formed in the decompression plunger that is housed in the plunger housing hole.

5. The decompressor for an internal combustion engine according to claim 2, wherein the emerging-and-submerging decompression portion is a decompression plunger inserted into a plunger housing hole communicatively connecting with a deep portion of the insertion hole of the camshaft and having an opening to the cam face of the valve-moving cam;

the decompression cam is formed at an end portion of the decompression shaft; and the decompression cam of the decompression shaft engages with a recessed portion formed in the decompression plunger that is housed in the plunger housing hole.

6. The decompressor for an internal combustion engine according to claim 3, wherein the emerging-and-submerging decompression portion is a decompression plunger inserted into a plunger housing hole communicatively connecting with a deep portion of the insertion hole of the camshaft and having an opening to the cam face of the valve-moving cam;

the decompression cam is formed at an end portion of the decompression shaft; and the decompression cam of the decompression shaft engages with a recessed portion formed in the decompression plunger that is housed in the plunger housing hole.

7. The decompressor for an internal combustion engine according to claim 1, wherein said falling-off prevention pin is off-set relative to a centerline of the decompression shaft and said decompression shaft includes a groove on an outer surface thereof for engagement by the falling-off prevention pin for preventing axial movement of the decompression shaft.

8. The decompressor for an internal combustion engine according to claim 7, wherein the falling-off prevention pin engages tangentially with the groove on the outer surface of the decompression shaft.

9. The decompressor for an internal combustion engine according to claim 4, wherein a decompression weight is operatively connected to the swing portion wherein the decompression weight overlaps the bearing when viewed in an axial direction and the decompression cam is positioned on an outer surface of the camshaft.

10. The decompressor for an internal combustion engine according to claim 9, wherein when the speed of revolutions of the camshaft increases, the swing portion swings with the centrifugal force of the decompression weight wherein the decompression cam is displaced inwardly to submerge below the cam face of an exhaust cam lobe.

11. A decompressor adapted to be used with an internal combustion engine for performing decompression and cancelling the decompression by moving a decompression shaft relative to a camshaft comprising:

a cam face of a valve-moving cam formed on the outer circumferential surface of the camshaft;

an emerging-and-submerging decompression portion of the decompression shaft emerge above and submerge below the cam face of the valve-moving cam formed on the outer circumferential surface of the camshaft;

said decompression shaft being supported so as to be rotatable freely;

said camshaft being supported by a bearing so as to be rotatable freely and driving an engine valve by use of the valve-moving cam;

said decompression shaft being inserted and fitted into an insertion hole of the camshaft for rotation relative to the camshaft, the insertion hole having an opening in a first end face of the camshaft and drilled in the axial direction of the camshaft at a position eccentric to the rotational axis of the camshaft;

a swing portion is provided at a first end of the decompression shaft, said swing portion extending along the first end face of the camshaft in a radial direction of the decompression shaft;

a falling-off prevention pin operatively positioned relative to the decompression shaft while allowing the decompression shaft to rotate, the decompression shaft is prevented from moving in the axial direction of the decompression shaft, the falling-off prevention pin being inserted in a pin insertion hole of the camshaft having an opening to the outer circumferential surface of the camshaft and intersecting, at least partially, the insertion hole;

the opening of the pin insertion hole of the camshaft is blocked by the bearing; and a bearing-restrict portion formed on the swing portion and protruding towards the bearing;

wherein said bearing is restricted to a limited movement in the axial direction of the camshaft by the bearing-restrict portion.

12. The decompressor adapted to be used with an internal combustion engine according to claim 11, wherein the decompression shaft is biased in a direction of rotational movement by a spring with its first end locked with the camshaft and its second end locked with the swing portion;

in a state where the swing portion biased by the spring is brought into contact with a stopper portion sticking out of an end face of the camshaft, the distance from the bearing located at a predetermined position, to the bearing-restriction portion is smaller than a distance which the bearing located at the predetermined position moves in the axial direction of the camshaft to open completely the opening of the pin insertion hole formed in the camshaft.

13. The decompressor adapted to be used with an internal combustion engine according to claim 12, wherein when the decompression shaft rotates against the biasing force of the spring, the restriction imposed by the bearing-restriction portion to the movement of the bearing in the axial direction of the decompression shaft is cancelled.

14. The decompressor adapted to be used with an internal combustion engine according to claim 11, wherein the emerging-and-submerging decompression portion is a decompression plunger inserted into a plunger housing hole communicatively connecting with a deep portion of the insertion hole of the camshaft and having an opening to the cam face of the valve-moving cam;

the decompression cam is formed at an end portion of the decompression shaft; and the decompression cam of the decompression shaft engages with a recessed portion formed in the decompression plunger that is housed in the plunger housing hole.

15. The decompressor adapted to be used with an internal combustion engine according to claim 12, wherein the emerging-and-submerging decompression portion is a decompression plunger inserted into a plunger housing hole communicatively connecting with a deep portion of the insertion hole of the camshaft and having an opening to the cam face of the valve-moving cam;

the decompression cam is formed at an end portion of the decompression shaft; and the decompression cam of the decompression shaft engages with a recessed portion formed in the decompression plunger that is housed in the plunger housing hole.

16. The decompressor adapted to be used with an internal combustion engine according to claim 13, wherein the emerging-and-submerging decompression portion is a decompression plunger inserted into a plunger housing hole communicatively connecting with a deep portion of the insertion hole of the camshaft and having an opening to the cam face of the valve-moving cam;

the decompression cam is formed at an end portion of the decompression shaft; and the decompression cam of the decompression shaft engages with a recessed portion formed in the decompression plunger that is housed in the plunger housing hole.

17. The decompressor adapted to be used with an internal combustion engine according to claim 11, wherein said falling-off prevention pin is off-set relative to a centerline of the decompression shaft and said decompression shaft includes a groove on an outer surface thereof for engagement by the falling-off prevention pin for preventing axial movement of the decompression shaft.

18. The decompressor adapted to be used with an internal combustion engine according to claim 17, wherein the falling-off prevention pin engages tangentially with the groove on the outer surface of the decompression shaft.

19. The decompressor adapted to be used with an internal combustion engine according to claim 14, wherein a decompression weight is operatively connected to the swing portion wherein the decompression weight overlaps the bearing when viewed in an axial direction and the decompression cam is positioned on an outer surface of the camshaft.

20. The decompressor adapted to be used with an internal combustion engine according to claim 19, wherein when the speed of revolutions of the camshaft increases, the swing portion swings with the centrifugal force of the decompression weight wherein the decompression cam is displaced inwardly to submerge below the cam face of an exhaust cam lobe.

* * * * *